United States Patent [19]

Abraham et al.

[11] 4,197,718

[45] Apr. 15, 1980

[54] MULTIDECK FREEZER AND ELIMINATION OF ALL ANTISWEAT HEATER WIRE

[75] Inventors: Fayez F. Abraham; Arthur Perez, both of Niles, Mich.

[73] Assignee: Tyler Refrigeration Corporation, Niles, Mich.

[21] Appl. No.: 876,748

[22] Filed: Feb. 10, 1978

[51] Int. Cl.[2] ..... A47F 3/04; F25B 47/00

[52] U.S. Cl. ..... 62/248; 62/256; 62/277

[58] Field of Search ..... 62/256, 255, 277, 278, 62/441, 248

[56] References Cited

U.S. PATENT DOCUMENTS

| | | | |
|---|---|---|---|
| 2,089,089 | 8/1937 | Fowler | 62/248 |
| 2,287,997 | 6/1942 | Jarvis | 62/248 |
| 2,657,546 | 11/1953 | Smith | 62/248 |
| 2,706,387 | 4/1955 | Swanson | 62/255 |
| 2,759,339 | 8/1956 | Kundert | 62/256 |
| 3,229,475 | 1/1966 | Balk et al. | 62/256 |
| 3,371,503 | 3/1968 | Perez | 62/256 |
| 3,984,223 | 10/1976 | Whistler, Jr. | 62/277 |

*Primary Examiner*—Lloyd L. King

*Attorney, Agent, or Firm*—LeBlanc, Nolan, Shur & Nies

[57] ABSTRACT

A refrigerated case having an access opening for access to the interior of the case by customers in a store where the case is used. Ducts are provided in the case for circulating refrigerated air across the access opening from a discharge opening at one end of the access opening to a return aperture at the other end of the access opening. The refrigeration system used in the case includes at least one conduit carrying refrigerant at a temperature higher than that of the air bands. At least a portion of this conduit is located adjacent the discharge opening to raise the temperature of the case in the vicinity of the discharge opening sufficiently to impede the accumulation of frost.

13 Claims, 4 Drawing Figures

MULTIDECK FREEZER AND ELIMINATION OF ALL ANTISWEAT HEATER WIRE

BACKGROUND OF THE INVENTION

In frozen display cases and particularly those used in commercial establishments such as supermarkets, a portion of the display case is left open for displaying the items for sale and providing access to these items for the consumers. These types of refrigerators are typically known as an open front upright refrigerator or open top coffin refrigerators. An example of the former appears in copending application Ser. No. 764,157 entitled "ROLL IN OPEN FRONT FROZEN FOOD REFRIGERATOR CASE"; an example of the latter is shown in U.S. Pat. No. 3,425,236 to Streed et al. In both of these refrigerators, an air curtain or band is employed across the open portion of the refrigerator to maintain the interior portion of the case where the frozen foods are displayed insulated from the ambient air on the outside of the refrigerator.

However, in using such air bands at least one air band will be substantially colder than the ambient air. As the band travels across the opening of the freezer, some of this ambient air may be mixed with the cold air band and deposited on the discharge and receiving openings on the ducts which provide the path for the air band.

In the receiving duct opening, a grill and liquid refrigerant coils have been provided to heat the grill sufficiently above the dew point thereby avoiding an accumulation of frost on the return grill. However, it is usually not feasible at the discharge opening of the duct to include such coils within the grill structure. This is because the grill may unnecessarily block the air flow path creating additional pressure drops which results in a need for a larger horsepower fan to force the air through the grill and coil structure. With regard to the cold air band, the whole purpose of the use of the air band will be defeated if it is heated as it leaves the discharge opening. As a result, although frost can be eliminated on the return grill, the discharge openings are not readily susceptible to the same kind of construction as the return opening. As a result, the moisture carried by the ambient air may crystallize on portions of the duct adjacent the discharge opening for the cold air. If this process is allowed to continue, frost may accumulate to such an extent that the cold air band will be diverted from its normal flow path thereby defeating the purpose of insulating the interior of the case. Also, there may be blockage of the discharge opening creating an adverse effect on the flow rate of the cold air band. Beyond these problems, there is also simply the unsightly appearance of large amounts of frost over operating portions of a refrigeration unit in a commercial establishment.

It is an object of the present invention to provide a means for heating areas of ducts adjacent the discharge opening for preventing the accumulation of frost thereon and its concomitant adverse effect on the flow path of the air band.

It is a further object of the invention to provide a separator between two discharge openings for separating air bands of different temperatures and maintaining the separator at a temperature above the dew point to prevent the accumulation of frost and ensure proper separation of the air bands.

It is a further object of the invention to utilize a portion of the return conduits of refrigeration systems for raising the temperature of the duct adjacent discharge openings on open front or open top refrigerators sufficiently above the dew point to avoid the accumulation of frost.

It is also an object of the invention to locate heating means adjacent the opening of a discharge duct for an air band to prevent the accumulation of frost without unnecessarily heating of the air band.

It is a further object of the invention to employ a system for heating areas of a freezer.

It is a further object of the invention to employ a system for heating areas of a freezer adjacent the opening of a discharge duct which simultaneously enhances the efficiency of refrigeration systems used in cooling the case to a desired temperature.

It is an additional object of the invention to provide a portion of refrigerant lines in both the discharge ducts and return ducts for the prevention of frost in areas on or adjacent these openings and simultaneously subcooling the liquid refrigerant carried in the lines thereby enhancing the efficiency of the refrigeration system.

This invention accomplishes the above and other objects in the following manner.

SUMMARY OF THE INVENTION

The invention generally relates to the use of liquid refrigerant lines at predetermined locations adjacent the discharge openings on open front or open top refrigerators utilizing air bands to prevent the accumulation of frost. By locating liquid refrigerant lines in this manner, not only is the accumulation of frost prevented, but also the efficiency of the refrigerator system is increased due to the fact that the refrigerant becomes subcooled before being delivered to an expansion valve.

Another feature of the invention is the use of these lines along a separator between one or more bands where multiplicity of air bands are used. In this way, the air bands which are typically of different temperatures are maintained sufficiently separated to ensure that they provide the kind of insulation for which they are designed.

More specifically, as described in the detailed description of the preferred embodiment, the invention relates to a coffin type refrigerator having a well portion for holding the goods to be displayed and an opening in the top for providing a view and access to the consumer. The front portion of the well is provided with a return duct which has a receiving opening for receiving an air band provided from the rear of the well. The rear of the well includes a discharge opening which directs the cold air band across the top of the well to the return duct. Underneath the bottom of the well within the case there are provided portions of the refrigerating system for cooling the air received by the return duct and forcing it toward the discharge opening. By providing an air band across the top of the well it insulates as well as cools the well of the case and the goods stored therein.

A grill is provided across the opening in the return duct with portions of a liquid refrigerant line being secured within the grill to heat the grill sufficiently above the dew point for preventing the accumulation of frost. On the exit or discharge duct, however, portions of the liquid refrigerant lines are secured within the case adjacent the top area on the opening of the duct to prevent the accumulation of frost without impairing the flow path of the cold air out of the discharge opening.

In another embodiment in an upright open front refrigerator display case where the discharge openings for air bands are maintained substantially vertically above the return duct, a separator is provided to separate at least two air bands which are forced downwardly toward the receiving duct in front of the case. The outermost air band is warmer air which approaches the ambient air temperature. The inner air band in the preferred embodiment is much colder and approaches the temperature of the air within the freezer which is approximately 0° F. A portion of the liquid refrigerant line is provided adjacent the separator between the two air bands to prevent any frost from accumulating thereon from the moisture which may be in the warm air on the outer air band. In this way, good separation is maintained between the air bands to secure the desired insulating properties of these bands as well as maintain the proper flow path to ensure that the bands do not become melded and mixed.

DESCRIPTION OF THE PREFERRED EMBODIMENT

Figure 1:
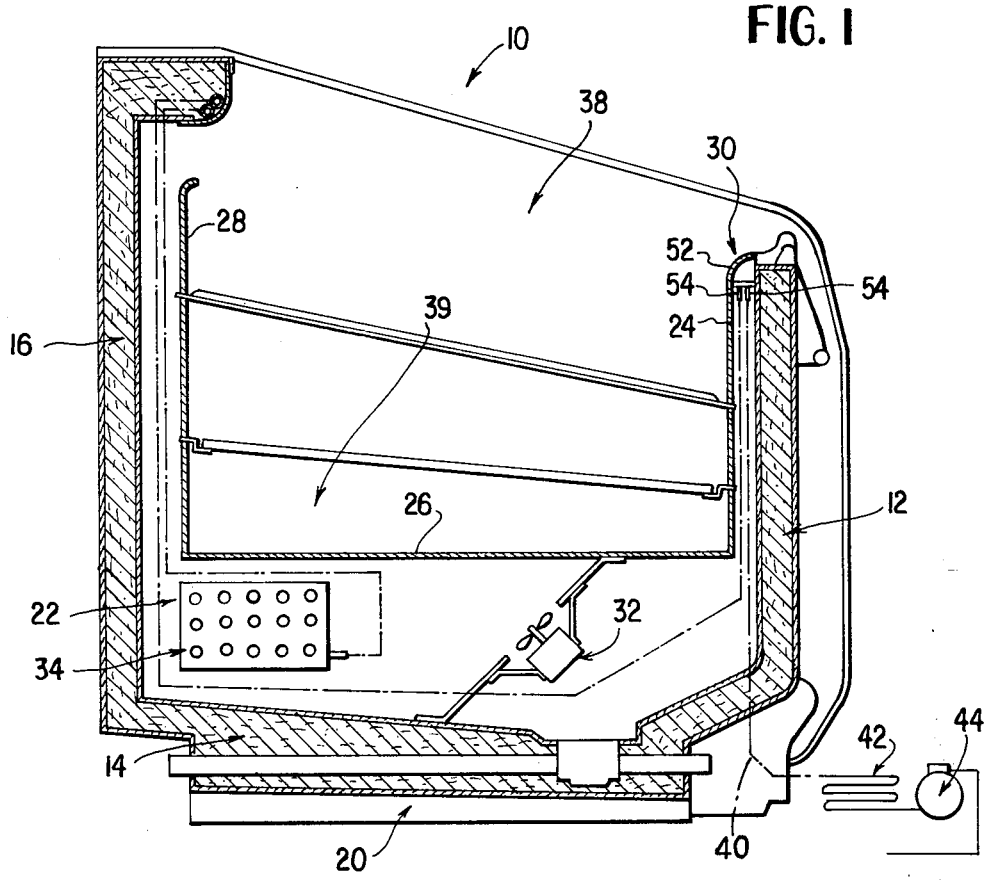
FIG. 1 is a cross section of a coffin refrigerator.

Referring now to FIG. 1, there is shown a refrigerated case 10 having an insulated front wall 12, an insulated bottom wall 14, an insulated rear wall 16, and any suitable end wall. A base 20 is provided of any suitable construction to support the case body.

An air circulating duct 22 is defined in the case by panels 24, 26, and 28 of any appropriate material such as sheet metal, respectively spaced inwardly from the walls 12, 14 and 16 and extending between the end walls. The forward vertical portion of duct 22 defined between the panel 24 and the front wall 12 is open to atmosphere through a return aperture 30 adjacent the top of the front wall. Air is drawn into the duct 22 through the return aperture by means of a fan or other suitable air moving means 32, to flow over an evaporating coil 34 and into and through the rear vertical portion of the duct defined between the panel 28 and the rear wall 16. The rear wall 16 may, in a well known manner, have a forward extension into which the rear duct portion extends. This rear portion of the duct is provided with an air outlet or discharge opening 36 which may be located either in the rear wall proper or in such extension. The case 10 is open between the return aperture 30 and the discharge opening 36 so as to provide an unobstructed opening indicated at 38 for affording access to the contents of the case which are contained in a well portion 39 defined by the panels 24, 26, and 28. Air discharged from the discharge opening 36 brings the case interior to the desired refrigerating temperature by moving about and past the contents and over the access opening 38 and flowing back through the return aperture 30 for recirculation and cooling by fan 32 and coil 34. The fan and coil are shown as disposed in an expanded portion of the duct 22 defined between the case bottom wall 14 and the bottom panel 26. Of course, more than one fan and coil may be provided depending on the length of the case.

The evaporating coil receives refrigerant through a refrigerant supply conduit 40 from a condenser 42 in which it is condensed to a liquid form after being compressed in a compressor 44 which draws the expanded gaseous refrigerant from the evaporating coil 34 through a return or suction line (not shown). The case 10 may be either of the self-contained type with the compressor and condenser located within it or the remote type with the compressor and condenser located exterior to the case. The refrigerating system comprising the compressor, condenser and evaporator with the connecting lines and conduits will, of course, also include the usual control elements and other components as well as means for removing frost accumulating on the evaporating coil or in the duct, but these do not form part of the invention and therefore, are not illustrated. A grill 52 is located across the return aperture 30 in the duct 22. A plurality of runs of tubing 54 is maintained within the grill for raising the grill temperature above the dew point to thereby avoid the accumulation of frost which otherwise might occur from the cold air passing from the discharge opening 36 into the opening 30. The details of the grill and the runs of tubing are described in U.S. Pat. No. 3,371,503 to Perez and which is included herein in total by reference. As a result, a detailed description of this feature of the invention will not be elaborated herein.

Figure 2:
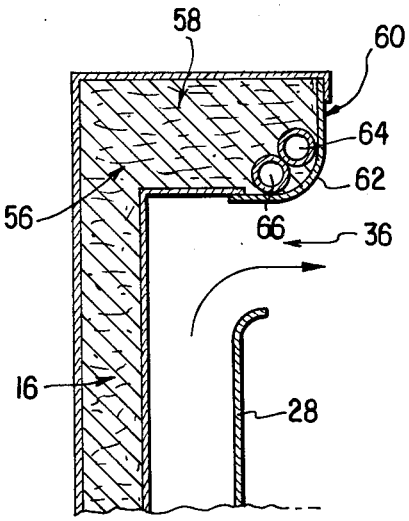
FIG. 2 is an enlarged cut-away portion of the refrigerator shown in FIG. 1.

In referring to FIG. 2, wherein an enlarged portion of the discharge area is shown, it can be seen that the rear insulated wall 16 includes an upright portion 56 and a lateral portion 58 which extends laterally toward the return aperture 30. This lateral portion 58 includes an exposed face 60 which carries an L-shaped plate 62 defining the limits of the opening 38. Liquid lines 64 and 66 are located adjacent the L-shaped plate 62 as shown for maintaining the plate above the dew point. These liquid lines extend substantially the entire length of the refrigerator case and thereby prevent accumulation of frost on any portion of the exposed face to the opening.

Condensed refrigerant flowing from the condenser 42 passes through the runs of liquid or refrigerant lines 64, 66 adjacent the L-shaped member 62. After completing the loop through these conduits, 64, 66, the line then returns to the coils 34.

The temperature of the refrigerant flowing in the lines 64,66 is higher than that of the refrigerating air leaving the discharge opening 36. While this refrigerating air is largely dehumidified by passing over the evaporating coil 34, on which it deposits a large portion of this moisture in the form of frost, it becomes mixed with and entrains some of the warmer and more humid ambient air which exists adjacent this passage. As a result, moisture in the ambient air may condense on portions of the case. In addition, the cold air flowing through the discharge opening could otherwise cool the L-shaped plate 62 sufficiently below the dew point to allow moisture in the ambient air adjacent this area to be deposited and crystallized on the plate and eventually accumulate frost. This is undesirable because purchasers, in reaching into the case may contact the frost or condensation and also because the frost may accumulate on the edges of the opening to such an extent as to interfere with the flow out of the discharge opening and possibly to divert the flow sufficiently that its insulating and cooling effects are diminished considerably.

In this embodiment, the tubing has an external diameter of not more than $\frac{5}{8}''$, and is maintained in close contact with the plate for heat conductive purposes. It should be understood that the number of runs and the exact manner in which the tubing is placed adjacent the discharge opening of the refrigerator is only shown as a preferred embodiment. Other coils and locations may be used so long as they comport with the feature of reducing the accumulation or eliminating entirely the accumulation of frost in the area of the discharge opening.

In addition to providing the foregoing advantages, the lines at the discharge opening improve the efficiency of the refrigerating system because of the additional heat lost by the refrigerant flowing in the line adjacent the L-shaped member 62. This heat loss reduces the temperature of the refrigerant below what it otherwise would be if it was delivered directly from the condenser to the expansion valve for expansion through an evaporator. Because of this additional reduction in temperature, the temperature of the gas resulting from the expansion process through the evaporator will be even lower thereby allowing additional heat to be withdrawn from the well portion of the refrigerator. Thus, the refrigeration capabilities are enhanced and made more efficient by the use of the liquid.

Figure 4:
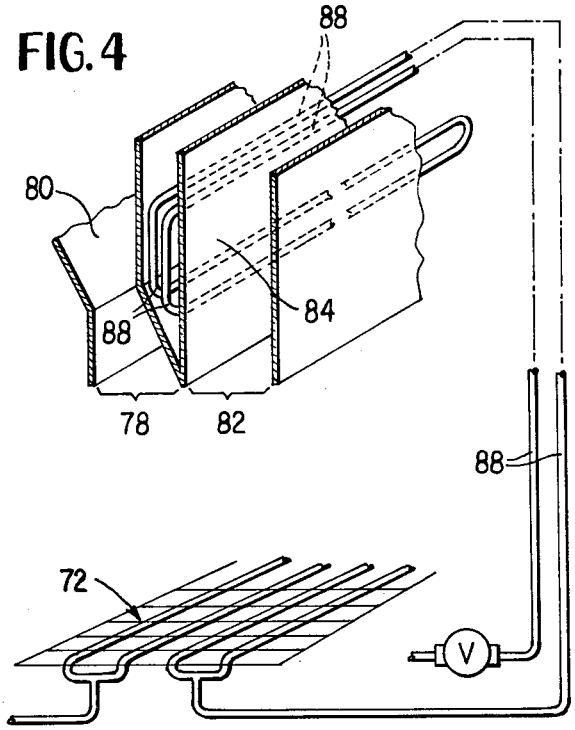
FIG. 4 is an enlarged view of a portion of the duct system shown in FIG. 3.
Figure 3:
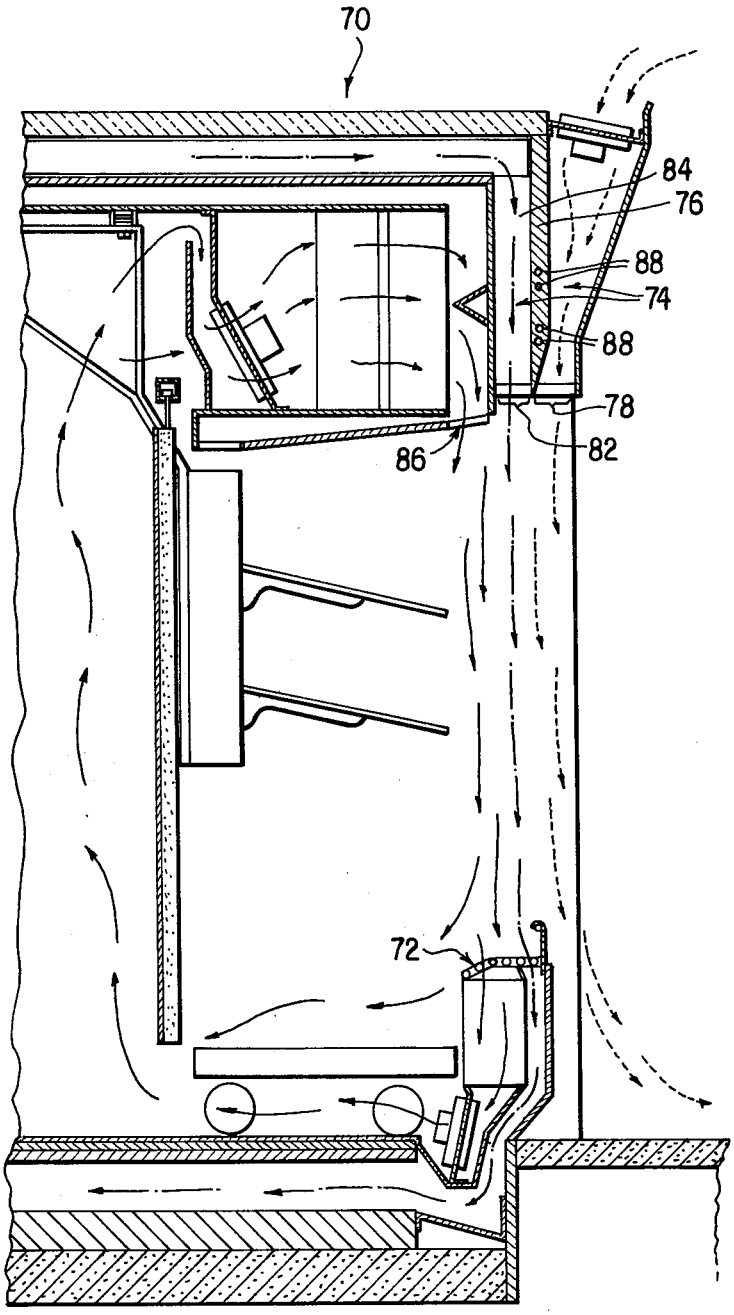
FIG. 3 is a partial cross sectional view of an upright open fron refrigerator.

Another embodiment is shown in FIGS. 3 and 4 where the discharge openings are located vertically above the receiving apertures. In this embodiment, the upright open front refrigerator 70 has an access opening with a return aperture 72 on a lower front part of the refrigerator for receiving air discharged primarily from the inner one of the two discharge openings 74 at the upper part of the refrigerator directly above the receiving aperture 72. In the refrigerator 70, as shown there are two openings 74 connected to separate ducts and separated from each other by an air band separator 76. Cold air is forced through cold air opening 82 which is received from cold air duct 84, and is directed downwardly toward the receiving aperture 72 where it is received and forced backwardly through portions of the refrigerator and returned to the cold air duct 84. In this way, the internal portions of the refrigerator are cooled by the movement of the cold air band across the front of the refrigerator and throughout the bottom portions of the refrigerator.

A colder air band interior of the cold air band described above is formed from air passing through opening 86 which is located rearwardly of cold air opening 82. Similarly, a warm air band located forwardly of the cold air band is expelled through opening 78. These air bands form an air curtain across the front of the refrigerator for cooling and insulating interior portions of the refrigerator.

The warm air is forced through warm air duct 80 and out of warm air opening 78 downwards in a path parallel to the cold air band. However, the warm air band is sufficiently displaced foward of the cold air band so that it will blow outwardly along the floor of the store where the refrigerator is utilized. This is necessary to prevent portions of the warm air from being melded with the cold air band which may cause an accumulation of condensation and frost as a result of the moisture in the warm air being subjected to the cold air band. It also may reduce the effectiveness of the cooling capabilities of the cold air band as it is circulated through the refrigerator. To maintain these air bands separate from one another, the separator 76 is included between the ducts and openings as shown. This separation ensures that the well portion of the refrigerator is insulated from the atmospheric air to maintain the goods within the well portion sufficiently refrigerated.

Liquid lines 88 are included in the air band separator to maintain its temperature sufficiently above the dew point to prevent any frost accumulation. As explained with regard to the coffin type freezer, as shown in FIG. 1, these liquid lines are a portion of the return lines from the condenser to the expansion valve. As with the coffin type refrigerator, by withdrawing heat from these lines in the separator, the efficiency of the refrigerator is enhanced.

Not only is frost accumulation avoided, which is unsightly, but it maintains a line of separation between the warm air band and the cold air band flowing out of the openings downwardly toward the return grill. If frost were allowed to accumulate here it may result in a change of the configuration of the separator to such an extent that the air bands would be melded together rather than being separated as desired. Thus, the use of the liquid refrigerant lines, as shown within the separator has the dual purpose of maintaining the air bands in the desired direction vertically so that at least the cold air band will be directed toward the return grill and the warm air band will be directed downwardly toward the front part of the case allowing it to escape onto the floor of the store, and a separation will be maintained to ensure the insulating qualities for which the air bands were designed.

What is claimed is:

1. A refrigerated case for refrigerated products having a wall structure providing an unobstructed opening for access to the interior of said case comprising:

a duct means formed by said wall structure for circulation of refrigerating air across said access opening, said structure including an air return aperture at one side of the opening and a discharge opening at the other side of said opening for supplying air in an air band which moves across said opening and is received by said return aperture;

a refrigeration system including conduit means for carrying refrigerant used in said system;

said conduit means being maintained at a temperature greater than that of the air band; at least a portion of said conduit means being located within said wall structure adjacent said discharge opening in heat transfer relationship therewith through said wall structure for limiting frost accumulation adjacent said opening sufficient to avoid interference with the flow of said air band.

2. The case according to claim 1 wherein said portion of said conduit includes a plurality of runs wherein each of said runs are in heat transfer relationship with said discharge opening.

3. The case according to claim 2 wherein said case is a coffin refrigerator case having an open top;

said case further including a front wall, a rear wall, and a bottom wall, defining a well portion therein beneath said open top; said rear wall defining said discharge opening and said front wall defining said receiving aperture and said plurality of runs being located in said rear wall adjacent said discharge opening.

4. The case according to claim 3 wherein said rear wall defines a top surface adjacent a discharge opening and a lower surface adjacent said discharge opening, said runs being located in said top surface adjacent said discharge opening for preventing the accumulation of frost from the ambient air at the interface between the air band and the portion of the rear wall in the vicinity of the discharge opening.

5. The case according to claim 4 wherein said rear wall is L-shaped in configuration having an upright leg and a lateral leg extending towards said front wall from said upright leg, the end of said upright leg defining one edge of said discharge opening, said runs being located adjacent said end of said lateral leg.

6. The case according to claim 5 wherein said end defines an end face and said lateral leg defines a lower surface extending rearwardly from said end face, at least one of said runs of said conduit being located on said lower surface adjacent said end face and another of said runs being located adjacent said end face displaced vertically from said lower surface.

7. A refrigerated case for refrigerated products having a wall structure providing an unobstructed opening for access to the interior of said case comprising:

(a) a refrigeration system for cooling an air band which is delivered across the openings of said refrigerated case;

(b) said system including an evaporator located in said air path for cooling said air as it is forced around and through said evaporator, an expansion valve connected to said evaporator for delivering refrigerant to said evaporator at reduced pressure for lowering the temperature of said refrigerator, a return conduit means, a compressor for raising the pressure and temperature of said refrigerant, a condenser being connected downstream of said compressor for transferring heat from the refrigerant thereby condensing the refrigerant, said condenser being connected by said return conduit means to said expansion valve, at said raised pressure and temperature;

(c) said case having a discharge opening for delivering said cold air across the opening of said case and a receiving aperture for receiving the air discharged by said discharge opening, and duct means having band means therein for drawing said air from said receiving aperture, forcing said air over said evaporator for cooling said air and delivering said cooled air to said discharge opening;

(d) at least one wall of said case defining said discharge opening and at least a portion of said return conduit means being located in said wall portion adjacent said discharge opening so as to be in heat transfer relationship therewith for preventing the accumulation of frost on that portion of the wall exposed to the atmosphere and adjacent said discharge opening.

8. The case according to claim 7 wherein another portion of said return conduit means is located in a grill carried by said receiving aperture for preventing the accumulation of frost in said opening.

9. A refrigerated case for refrigerated products having a wall structure providing an unobstructed opening for access to the interior of said case, first duct means for circulation of cool air across said access opening, said refrigerator having two discharge openings located above a receiving aperture for receiving air discharged from one of said discharge openings, one of said discharge openings being connected to said first duct means for defining an inner air curtain across said opening, and the other of said discharge openings being connected to a second duct means for providing an outer air curtain across said opening, said opening being separated by a separator means for preventing the mixing of said air curtains, a refrigeration system having conduits for fluid refrigerant warmer than the cool air, at least a portion of said conduits being located in said separator means for preventing the accumulation of frost thereon and maintaining said air curtains in separate and distinct paths.

10. The case according to claim 9 wherein said conduits include a plurality of runs.

11. The case according to claim 10 wherein said receiving aperture includes a grill located in said aperture and said grill carrying another portion of said conduits.

12. The case according to claim 11 wherein said inner air curtain is a cold air curtain and said receiving aperture being located substantially vertically below said one discharge opening for receiving said inner air curtain.

13. The case according to claim 12 wherein said case defines a front wall, said front wall defining said receiving aperture, said front wall being located relative to said separator and said inner and outer air curtains for forcing at least a portion of said outer air curtain to the floor adjacent said front wall away from said inner air curtain.

* * * * *